US009404705B2

(12) United States Patent
Kennedy

(10) Patent No.: US 9,404,705 B2
(45) Date of Patent: Aug. 2, 2016

(54) ROTARY CAM RELEASE TRIGGER DEVICE FOR A CROSSBOW

(71) Applicant: Bennie Kennedy, Frankton, IN (US)

(72) Inventor: Bennie Kennedy, Frankton, IN (US)

( * ) Notice: Subject to any disclaimer, the term of this patent is extended or adjusted under 35 U.S.C. 154(b) by 200 days.

(21) Appl. No.: 14/052,747

(22) Filed: Oct. 13, 2013

(65) Prior Publication Data

US 2014/0102431 A1 Apr. 17, 2014

Related U.S. Application Data

(60) Provisional application No. 61/713,555, filed on Oct. 14, 2012, provisional application No. 61/727,726, filed on Nov. 18, 2012.

(51) Int. Cl.
*F41B 5/12* (2006.01)
*F41B 5/14* (2006.01)

(52) U.S. Cl.
CPC ..... *F41B 5/12* (2013.01); *F41B 5/1469* (2013.01)

(58) Field of Classification Search
CPC ..... F41B 5/12; F41B 5/1469; F41B 5/123; F41B 7/046
See application file for complete search history.

(56) References Cited

U.S. PATENT DOCUMENTS 3,937,206 A 2/1976 Wilson
4,860,720 A 8/1989 Todd
5,224,463 A 7/1993 Townsend
5,598,829 A 2/1997 Bednaer
5,649,520 A 7/1997 Bednaer
5,884,614 A 3/1999 Darlington
6,205,990 B1 3/2001 Adkins
6,736,123 B1 5/2004 Summers et al.
6,802,304 B1 10/2004 Chang
7,770,567 B1 8/2010 Yehle
8,091,540 B2 1/2012 Matasic et al.
2006/0144380 A1 7/2006 Kempf
2009/0064978 A1* 3/2009 Matasic ..... F41B 5/12 124/35.1
2011/0197869 A1 8/2011 Matasic et al.

* cited by examiner

*Primary Examiner* — Melba Bumgarner
*Assistant Examiner* — Amir Klayman
(74) *Attorney, Agent, or Firm* — John D Ritchison; Ritchison Law Offices, PC

(57) ABSTRACT

A crossbow trigger and bowstring release mechanism with improved bowstring retention and release characteristics. The device enhances accurate and safe shooting with the crossbow. The trigger mechanism comprises a spring operated pivotal cam string release mechanism for releasably holding a bowstring in a drawn position. The string release latch is pivotable about a pivot point and has associated therewith a first sear surface. The trigger mechanism further includes a pivotal rocker latch member having a second sear surface which engages the cam pivot mechanism. The sear has an extended arm that engages a safety hammer release. Finally there is an improved dry-fire prevention pivot mechanism that engages an arrow when loaded to launch. When no arrow is present the dry-fire rocker engages the cam mechanism and prevents the movement of the cam to release the bowstring.

10 Claims, 10 Drawing Sheets

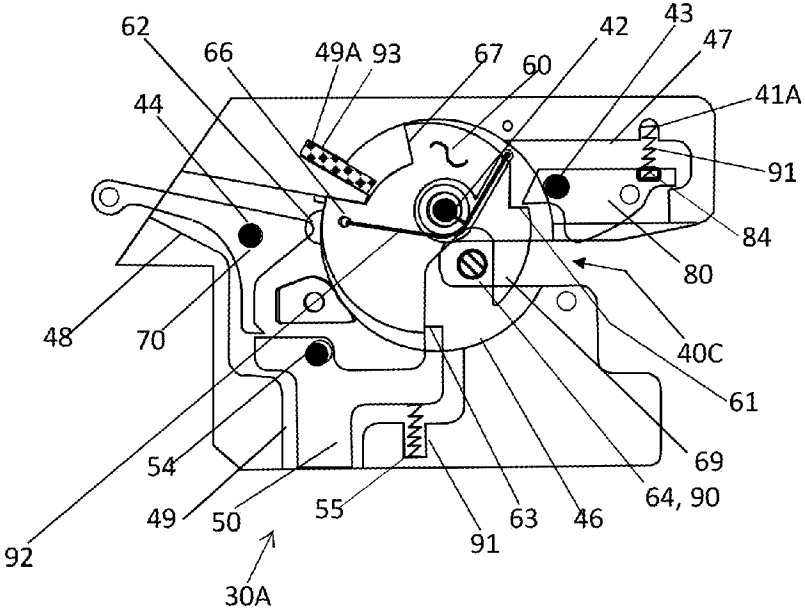
Fig. 2 B
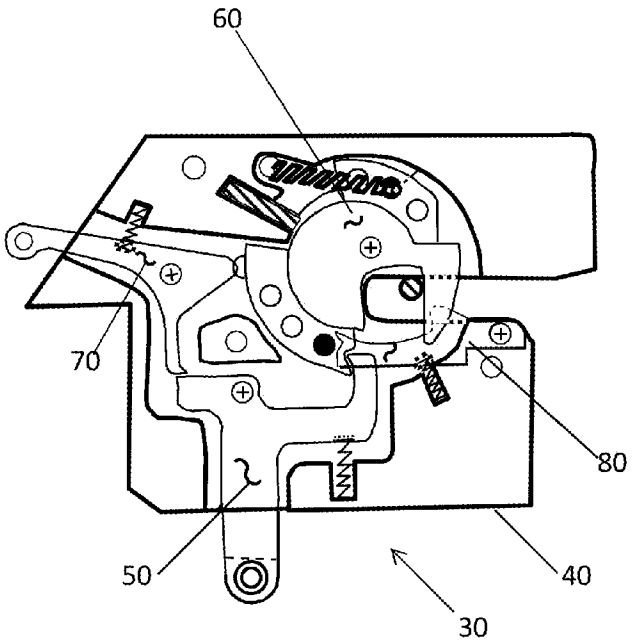
Fig. 2 A
See Components Fig. 3
Figs. 2

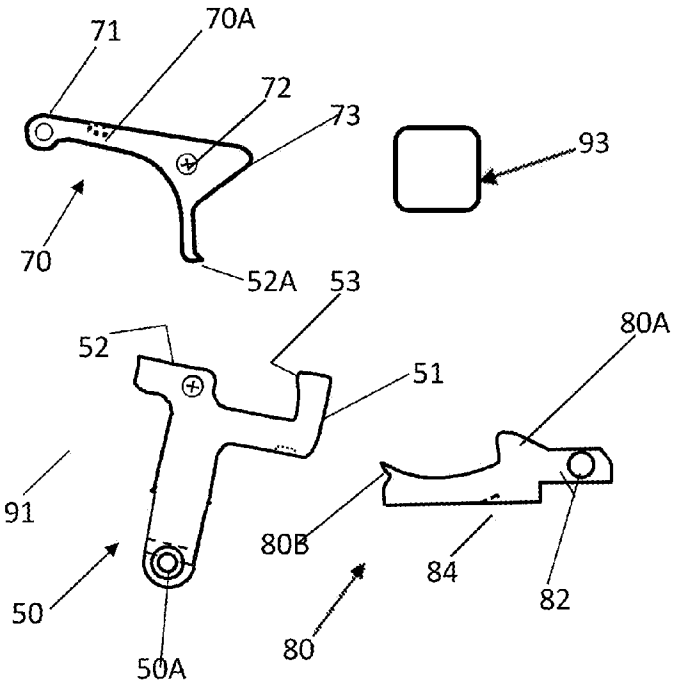
Fig. 6 B
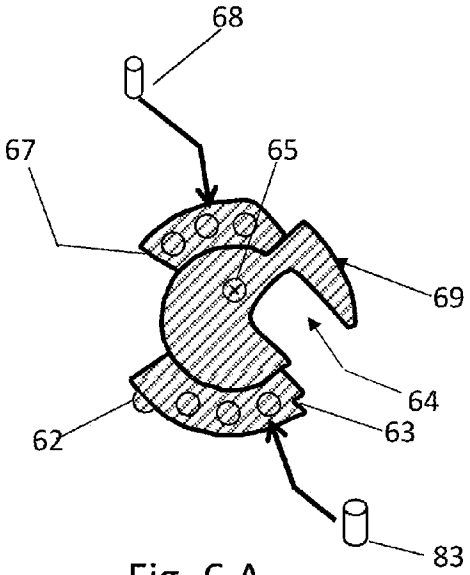
Fig. 6 A
Figs. 6

112

115

111

114

110

113

Figs. 9 — All Figures are Prior Art

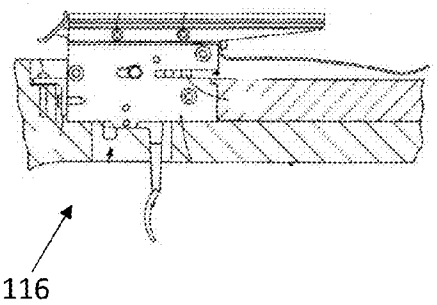
Fig. 10 A
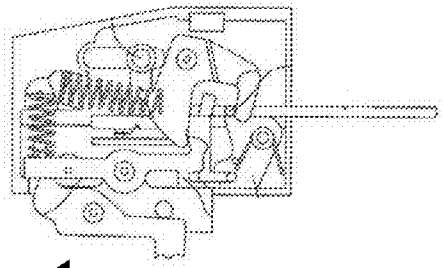
Fig. 10 B
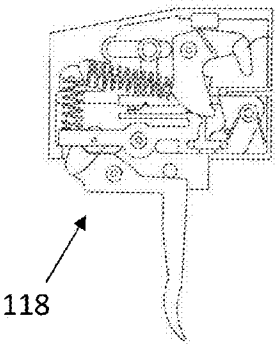
Fig. 10 C
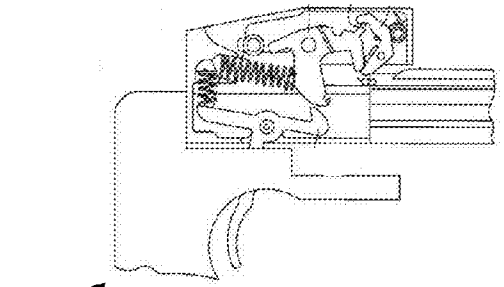
Fig. 10 D
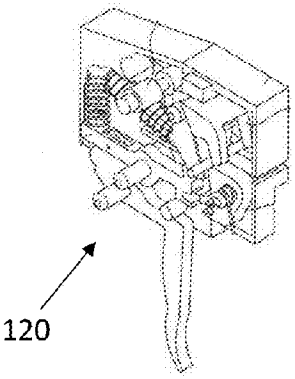
Fig. 10 E
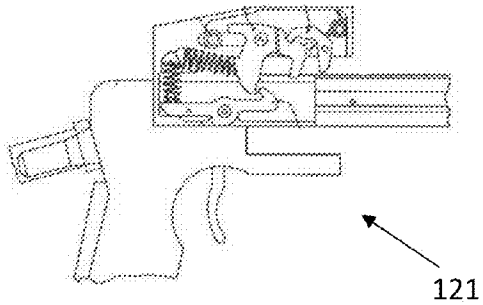
Fig. 10 F
Figs. 10
All Figures are Prior Art

ROTARY CAM RELEASE TRIGGER DEVICE FOR A CROSSBOW

CROSS-REFERENCE TO RELATED APPLICATIONS

This application claims the benefit of Provisional Patent Application Ser. No. 61/713,555 filed Oct. 14, 2012 by Ben Kennedy and entitled "Rotary Cam Release/Trigger device for a Crossbow" and Provisional Patent Application Ser. No. 61/727,726 filed Nov. 18, 2012 by Ben Kennedy and entitled "An Improved Rotary Cam Release/Trigger device for a Crossbow".

FIELD OF INVENTION

This invention relates to a rotary cam release/trigger device for a crossbow. The present disclosure is directed to an archery crossbow trigger or bowstring release device. Particularly the present disclosure is directed to a trigger mechanism having a cam operated release, an improved dry-fire prevention mechanism, and a convenient spring operated safety release. For archery equipment and, more particularly, a crossbow, the bowstring release assembly provides control and consistency in the release of a bowstring.

FEDERALLY SPONSORED RESEARCH

None.

SEQUENCE LISTING OR PROGRAM

None.

BACKGROUND—FIELD OF INVENTION AND PRIOR ART

Background

Crossbows in general have been used for many years as a weapon for hunting, fishing, and for target shooting. Significant development of the crossbow has occurred to increase the force with which an arrow is shot, to increase shooting accuracy, and to make the crossbow safe. In general, the crossbow includes a stock incorporating a trigger mechanism for selectively holding and releasing a bowstring used to propel an arrow.

The trigger mechanism used to hold and release a bowstring should allow a user to easily hold a drawn bowstring in a cocked position while prohibiting the bowstring from inadvertently releasing from the cocked position. The trigger mechanism must, therefore, positively hold a drawn bowstring, allowing release only upon actuation of a trigger. Unfortunately, in many instances, crossbow trigger mechanisms do not incorporate safe and reliable release mechanisms which positively hold a drawn bowstring while allowing a smooth release to improve shooting accuracy.

Another important characteristic of a crossbow trigger mechanism involves the pressure and actuation characteristics of the trigger, affecting the smoothness and accuracy with which a drawn bowstring is released. The release characteristics of the trigger mechanism are therefore very important to the shooting accuracy and repeatability of a crossbow.

Problems Addressed:

As target and sport archery increases in popularity, several shortcomings of the standard archery equipment limit many users and lead to safety concerns for all. In order to improve the experience and safety, changes and improvements to the standard equipment in the areas of releasing the bowstring, having a convenient safety mechanism and preventing dry-fires are needed. Once a crossbow is properly configured in the regular position, the user may cock the crossbow in preparation for loading and firing a crossbow arrow or bolt via the bowstring. In general, the crossbow imparts a substantial amount of force in order to accurately propel a bolt with respect to any intended target. In order to store in the crossbow mechanism the energy needed to impart such force to the bolt or arrow, the user must draw the bowstring back along the stock to a distance extent sufficient to preload or "cock" the crossbow. This task can also be quite strenuous, generally requiring the user to generate a large amount of force.

A user may cock the crossbow via direct manual cocking. For example, a user that has sufficient strength may elect simply to hold the stock with one hand, and draw the bowstring backward along the stock to a sufficient distance extent with the other. Alternatively, a user with less inherent strength may cock the crossbow via indirect manual cocking. For example, a user may choose to employ an "assist device" such as a cord assembly. The cord assembly may include a cord and a pair of manual gripping handles disposed at opposite ends of the cord. Such a user may then use their feet to hold a crossbow pointed downward against the ground, couple the cord of the cord assembly to a bowstring of the crossbow, and then pull upward as necessary with both hands using the gripping handles. Either way, the manual cocking of a crossbow requires a user to generate considerable force, which can be a safety concern if dry-fire is not prevented or if the safety hammer is not engaged with the release.

A cocked crossbow embodies a great deal of stored energy. Such stored energy may be released in different ways. For example, a user can load an arrow or "bolt" onto a cocked crossbow and thereafter actuate an associated trigger mechanism, thus firing the bolt from the crossbow (i.e., energy release via transfer/conversion). For another example, a user may decide not to fire a bolt, but rather to "de-cock" the crossbow by reversing (e.g., in a safe, controlled fashion) the process by which the crossbow was cocked (i.e., energy release via dissipation). In most if not all instances, however, it will generally be important to prevent the crossbow from releasing such stored energy prematurely, or as a result of an accident. For example, while the crossbow is being moved during hunting, but prior to firing, it may be advantageous for the hunter or user to keep the crossbow fully cocked (e.g., for purposes of readiness), but unloaded (e.g., for purposes of safety and/or convenience), such that all a user would need to do to fire the crossbow, once the decision to do so is finally made, is to load a bolt onto the crossbow stock, and then actuate an associated trigger mechanism (e.g., by pulling a trigger), allowing the bowstring to move forward and outward of the trigger mechanism, thereby rapidly propelling the bolt away from the crossbow along the same forward direction.

Keeping the trigger mechanism in such an advanced state of readiness can tend to minimize both the total amount of time needed, as well as the total amount of physical effort required to be expended in actually firing the crossbow, once the decision is finally made to do so. Unfortunately, however, the same advanced state of firing readiness in the trigger mechanism can tend to leave the crossbow vulnerable to so-called "dry fire", in which a cocked bowstring of the crossbow is unintentionally released prior to a bolt being loaded in the crossbow, such that the time and effort needed to cock the crossbow in the first place must now be repeated. Dry fire can occur in any number of situations, including, for example, situations in which the crossbow is dropped, or in which the trigger mechanism is mistakenly actuated (e.g., while the crossbow is being moved, stowed, or retrieved during hunting).

In order to protect against dry fire, modern crossbow designs may include a corresponding safety mechanisms. For example, a crossbow may include a stock, a trigger mechanism, and a stop mechanism. The stop mechanism may include an arm that may be biased (e.g., via spring-loading) toward movement in the counter clockwise direction, but is deflectable as necessary in the opposite rotational direction. The stop mechanism may further include a manually operable handle. During a process of cocking the crossbow, the bowstring is drawn along the stock toward the trigger mechanism. Reaching the position of the stop mechanism, the bowstring will tend, as it passes the arm, to displace the arm upward and away from the rearward directed path of the bowstring along the stock. Upon further drawing of the bowstring into the trigger mechanism and past the position of the stop mechanism to complete cocking of the crossbow, the arm, now no longer in contact with the bowstring, is urged (e.g., via the aforementioned spring load) or otherwise allowed to rotate downward again, such that the arm is caused to rest against the stock. The current rotary cam version by Kennedy now has a dry-fire prevention mechanism in an simple yet improved configuration and requires nearly full cooperation of the arrow into the trigger slot prior to release.

In firing operation of the crossbow (i.e., after the same has been cocked as described above), the dry fire prevention function of the stop mechanism is overridden. More particularly, a bolt may be loaded onto the crossbow by being moved backward along the stock along the direction, toward and into the trigger mechanism. In the process of being loaded onto the crossbow, a tail end of the bolt "displaces" the arm upwards and out of the rearward path of the bolt. Conventionally, at this time, and up until a moment of firing the bolt, the arm may be allowed to rest atop a longitudinal shaft of the bolt. Upon the trigger mechanism being actuated, the bowstring is released. Since the arm of the stop mechanism remains displaced away from a forward path of the bowstring and of the bolt along the direction, the stop mechanism of the conventional device presents no obstruction with respect to continued forward motion of the string and bolt.

The crossbow with a conventional release is further operable in a dry fire prevention mode, with respect to which the arm of the stop mechanism, and tends to rest against the stock of the crossbow. More particularly, after the crossbow has been cocked (but before the crossbow has been loaded with a bolt as described above) the trigger mechanism may be vulnerable to an inadvertent actuation, normally leading to an unintended release of the bowstring from the trigger mechanism. This can lead to disastrous results such as splitting the limbs and causing irreparable harm to the crossbow or worse to the user.

Conventionally, upon the now released bowstring moving forward to the position of the stop mechanism, the arm serves to "catch" the bowstring at a position along the stock just forward of the trigger mechanism. Thereafter, the arm further can cooperate with the stock to block any further forward motion of the bowstring. The user is now permitted to re-cock the bowstring by drawing the bowstring back into engagement with the trigger mechanism, or, alternatively, to carefully allow a full, but now gradual release of the bowstring by a) partially drawing the bowstring back toward the trigger mechanism, b) manually displacing the arm upward and away from the bowstring by pulling downward on the handle, and c) permitting the bowstring to move slowly forward again along the direction. Here, by limiting unintended discharge of the bowstring to a relatively small throw during dry fire, the stop mechanism provides a very important safety feature. However, even when working as intended, the stop mechanism in conventional releases not only still fails to prevent dry fire, but also requires the bowstring to be redrawn to at least some extent backward along the stock and back into engagement with the trigger mechanism to restore the crossbow to the fully cocked state. Accordingly, apparatus and methods for preventing unintended discharge of a trigger mechanism of an unloaded crossbow remain both desirable and necessary.

Prior Art

Many prior art bowstring release devices utilize a trigger mechanism that is actuated by the archer. U.S. Pat. No. 3,937,206 to Wilson (1976) discloses a bowstring release device having a pivotable trigger mechanism that initiates the bowstring release mode. A rope loop is attached to the housing of the release device and extends around the bowstring for engagement. The rope loop is hooked in a notch formed in a release wheel to hold the bowstring as it is drawn. A sear block bears against the release wheel and is held against movement by a trigger block, thus holding the release wheel in position for drawing the bowstring. When the archer pulls the trigger lever on the trigger block, the trigger block pivots to disengage from the sear block. The sear block is no longer able to hold the release wheel which rotates to allow release of the bowstring. U.S. Pat. No. 5,598,829 issued to Bednar (1997) is entitled Crossbow dry fire prevention device. It demonstrates a device for a crossbow a dry-fire prevention mechanism. device for use with a crossbow. The crossbow includes a trigger mechanism which may have a guide slot into which a bowstring is drawn and retained for firing. A pivotal string catch member is positioned relative to the trigger mechanism to selectively extend into a string catching position which will catch and retain the bowstring should it be released from the trigger mechanism without an arrow in a firing position in the crossbow. The string catch member may include an arrow contacting surface to engage an arrow positioned to be fired from the crossbow, wherein, movement of the arrow to the firing position causes the string catch member to be moved out of the string catching position.

U.S. Pat. No. 5,649,520 also issued to Bednar (1997) is entitled Crossbow trigger mechanism. It demonstrates a mechanism providing improved bowstring retention and release characteristics. The invention further provides a safe and reliable trigger mechanism which enhances accurate shooting with the crossbow. The trigger mechanism comprises a pivotal string release latch for releasably holding a bowstring in a drawn position. The rearward extending portion of the trigger applies force on the rearward extending portion of the rocker latch member to cause pivoting thereof for disengagement of internal components. It also features an integral sight adjustment system for use with a rear sight of the crossbow. U.S. Pat. No. 5,224,463 issued to Townsend (1993) is entitled Bowstring release assembly. This device comprises a housing that receives the operative components that facilitate bowstring release motion. A gear assembly initiates and actuates the release motion. A rack and a pinion form the gear assembly. A trigger operates the rack to translate within the housing. Additionally, a rope loop anchored to the housing may be provided to wrap around the bowstring and hook onto the peg for restraint.

Various bowstring other release devices have been developed in order to normalize the release motion. The mechanics of these devices is intended to provide uniformity and consistency from use to use. U.S. Pat. No. 4,860,720 issued to Todd (1989) discloses a bowstring release device with a pivotable trigger that operates to extend and retract a sleeve mounted on the housing. Shown are a pair of ball bearings are mounted in the housing on opposing sides of a slot that receives the bowstring. When the sleeve is in the extended position, the ball bearings are pressed firmly together and restrain the bowstring in the slot. The sleeve retracts when the trigger is pulled, allowing the ball bearings to separate and release the bowstring. U.S. Pat. No. 7,770,567 issued to Yehle (2010) shows a safety trigger for a crossbow. It comprises a caliper, a trigger mechanism, a safety mechanism, and a bolt sensor. The caliper retains or releases a bowstring. The trigger mechanism holds the caliper against its bias to retain the bowstring, or releases the caliper to release the bowstring and fire the crossbow.

U.S. Pat. No. 8,091,540 issued to Matasic, et al. (2012) entitled Crossbow was a crossbow that includes several typical trigger mechanisms to releasably engage a crossbow bowstring brought within the trigger housing. The crossbow further includes a trigger adapted to releasably engage the bowstring catch, the trigger being further adapted to be selectively actuated by a user so as to cause the trigger to release the bowstring catch, thereby causing the bowstring catch to release a crossbow bowstring. Other options are shown. U.S. Patent Publication No. 2011/0197869 by Matasic, et al. published in 2011 shows a crossbow having improved limbs, safety mechanisms and release mechanisms. The disclosure provides improved bows (e.g., crossbows and/or vertical bows). More particularly, the present disclosure provides advantageous bows having improved limbs, trigger releases, safety mechanisms and/or dry fire mechanisms.

Finally, the field of the present invention have several other devices that relate to crossbows. For examples, U.S. Pat. No. 5,884,614 entitled "Crossbow with improved trigger mechanism" issued in 1999 to Darlington et al; U.S. Pat. No. 6,205,990 entitled "Dry-fire prevention mechanism for crossbows" issued in 2001 to Adkins; U.S. Pat. No. 6,736,123 entitled "Crossbow trigger" issued in 2004 to Summers et al; U.S. Pat. No. 6,802,304 entitled "Trigger assembly with a safety device for a crossbow" issued in 2004 to Chang; and U.S. Patent Publication No. 2006/0144380 entitled "Crossbow" published in 2006 in the name of Kempf.

As far as known, and based on the search, there are no rotary cam release/trigger devices for a crossbow or the like. The improved location below the arrow and the increased cam interference with the dry fire mechanism serves as an added feature to secure the bowstring from being released without the presence of a knock or arrow. It is believed that this product is unique in its design and technologies.

SUMMARY OF THE INVENTION

This invention is a rotary cam release/trigger devices for a crossbow. Taught here are the ways the present invention provides a safe and reliable trigger mechanism which enhances accurate shooting with the crossbow. The trigger mechanism comprises a spring operated pivotal/rotary cam string release mechanism for releasably holding a bowstring in a drawn position. The string release latch is pivotable about a pivot point and has associated therewith a first sear surface. The spring operated trigger mechanism further includes a pivotal rocker latch member having a second sear surface which engages the cam pivot mechanism. The sear has an extended arm that engages a spring operated safety hammer release. Finally there is a dry-fire prevention pivot mechanism that engages an arrow when loaded to launch. When no arrow is present the dry-fire rocker engages the rotary cam mechanism and prevents the movement of the cam to release the bowstring.

The preferred embodiment of the rotary cam release/trigger devices for a crossbow is comprised of a spring operated pivotal cam string release mechanism for releasably holding a bowstring in a drawn position, the pivotal/rotary cam release latch is pivotable about a pivot point and has associated therewith a first sear surface; a pivotal rocker latch member having a second sear surface which engages the cam pivot mechanism; the pivotal sear which has an extended arm that engages a safety hammer release; the safety hammer release; a dry-fire prevention pivot mechanism that engages an arrow when loaded to launch; a linkage to a trigger pull; the trigger pull; and an encasement that essentially contains all the components and provides the structure to maintain the pivots and the structural continuity to the release device for mounting the release to the crossbow between the side rails and wherein the release device provides a safe and reliable trigger mechanism which enhances accurate shooting with the crossbow.

The newly invented rotary cam release/trigger devices for a crossbow may be manufactured at low volumes by very simple means and in high volume production by more complex and controlled systems.

OBJECTS AND ADVANTAGES

There are several objects and advantages of the rotary cam release/trigger devices for a crossbow. There are currently no known crossbow trigger or release devices known that are effective at providing the objects of this invention.

The use of the rotary cam release/trigger devices for a crossbow offers several advantages as listed herein:

Advantages and Benefits

| Item | Advantages |
|---|---|
| 1 | Fast release |
| 2 | Full spring operated safety (dry fire & safety hammer) |
| 3 | Easy location for reaching safety release with the user's hand and/or fingers |
| 4 | Smooth bowstring to arrow path (no interference) |
| 5 | Fewer parts compared with traditional trigger/release |
| 6 | May be interchanged with existing trigger/release mechanisms in crossbow units |
| 7 | OEM and Replacement Sales |

Finally, other advantages and additional features of the present rotary cam release/trigger devices for a crossbow will be more apparent from the accompanying drawings and from the full description of the device. For one skilled in the art of crossbows and bowstring release mechanisms, it is readily understood that the features shown in the examples with this product are readily adapted to other types of crossbow and archery trigger mechanisms and devices.

DESCRIPTION OF THE DRAWINGS—FIGURES

The accompanying drawings, which are incorporated in and constitute a part of this specification, illustrate an embodiment of the rotary cam release/trigger devices for a crossbow that is preferred. The drawings together with the summary description given above and a detailed description given below serve to explain the principles of the rotary cam release/trigger devices for a crossbow. It is understood, however, that the rotary cam release/trigger devices for a crossbow is not limited to only the precise arrangements and instrumentalities shown.

FIGS. 1 A through 1 D are sketches of the general rotary cam release/trigger devices for a crossbows.

FIGS. 2 A and 2 B are sketches of the preferred and alternative rotary cam release/trigger devices with components and features noted.

FIGS. 6 A and 6 B are prototype parts of the rotary cam release/trigger devices.

Figures 7, 7A, 7B, 7C, 7D:
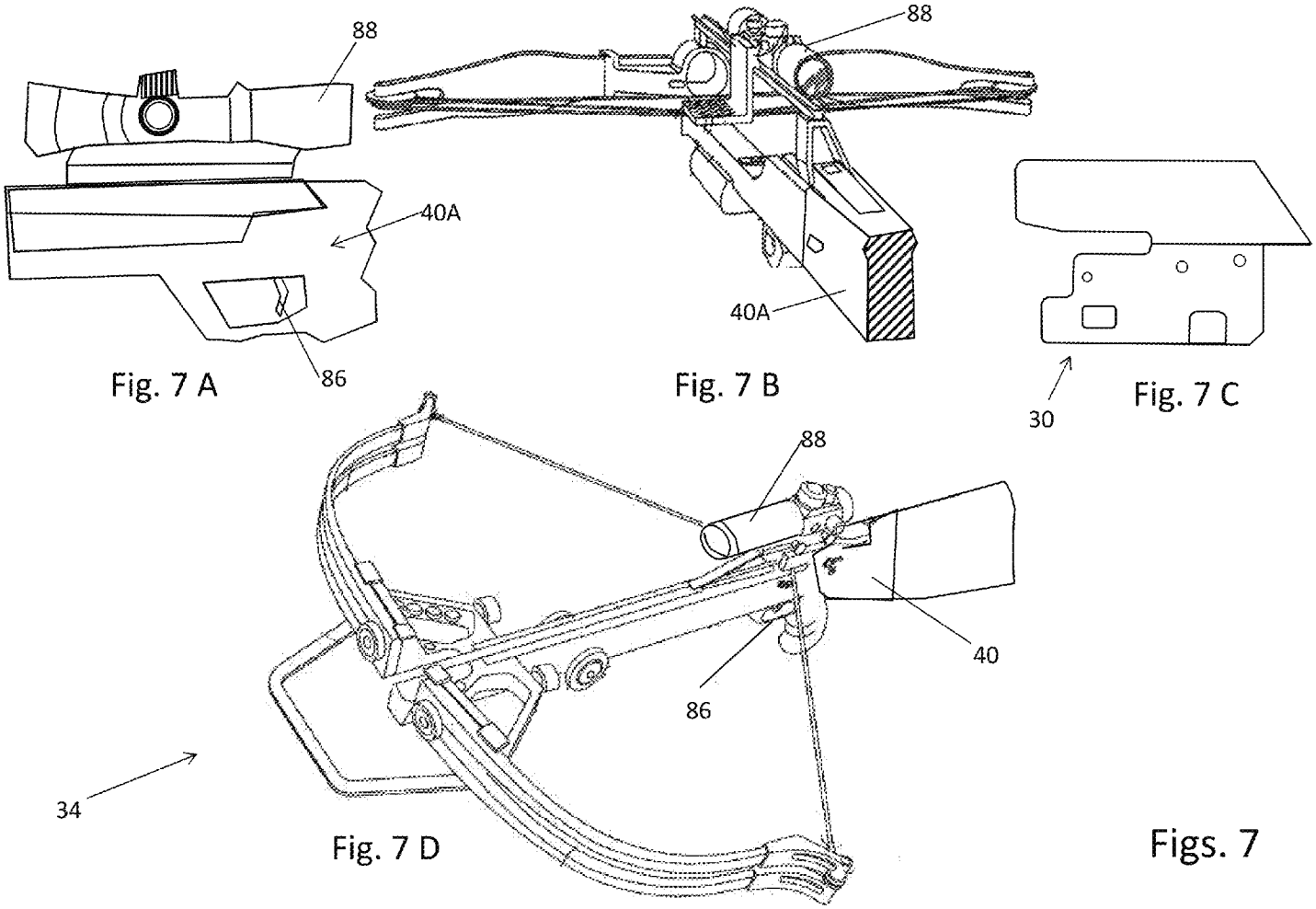

FIGS. 7 A and 7 D are views of the rotary cam release/trigger devices mounted onto a crossbow.

Figure 8:
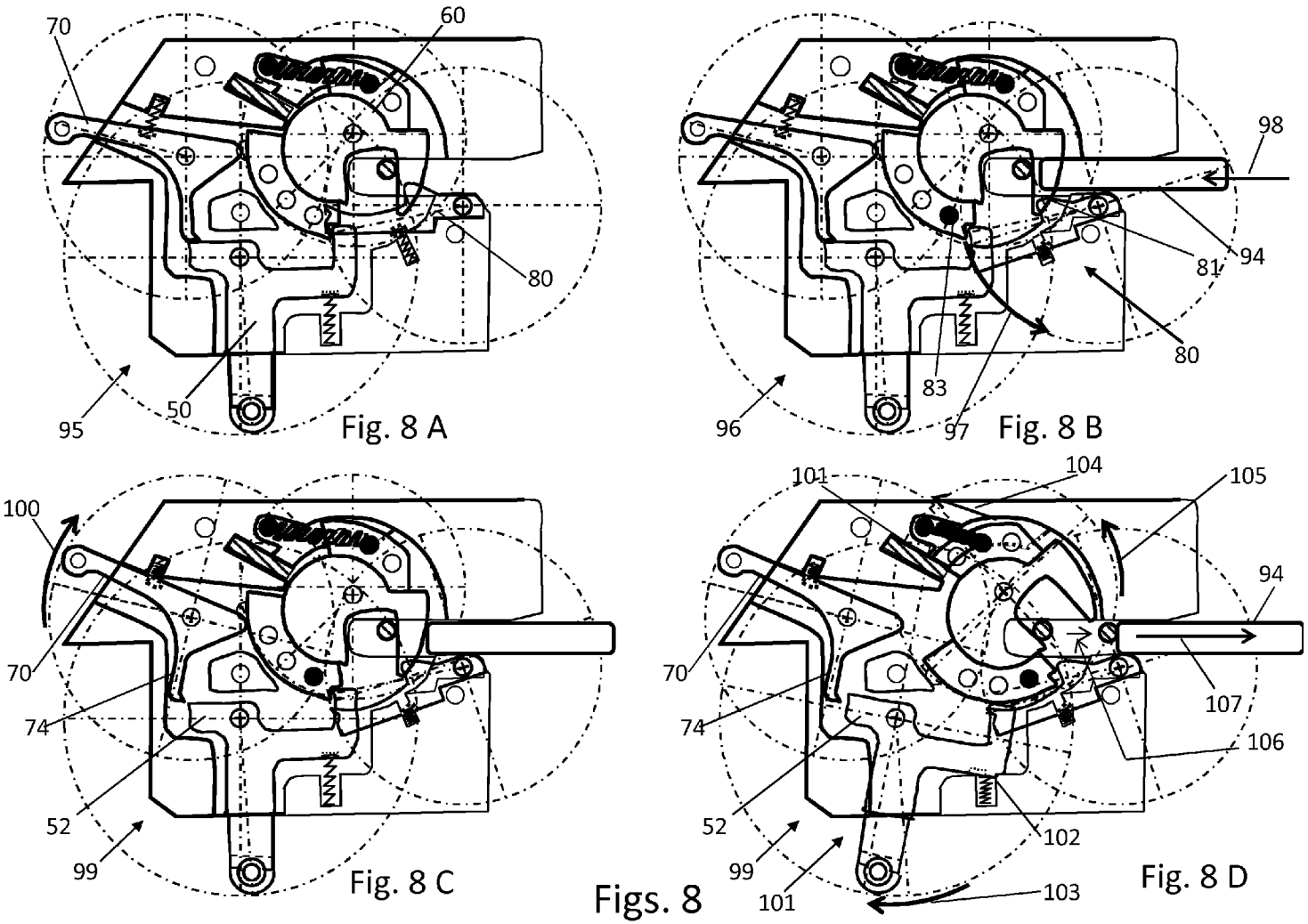
Figure 9C:
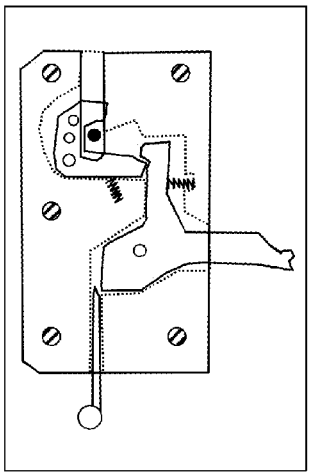
Figure 9F:
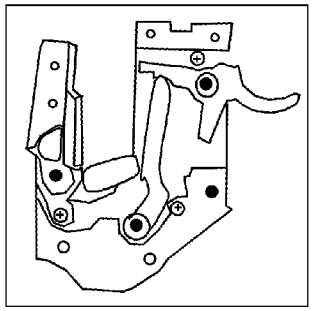
Figure 9B:
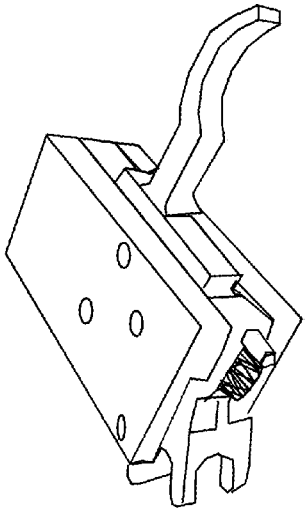
Figure 9E:
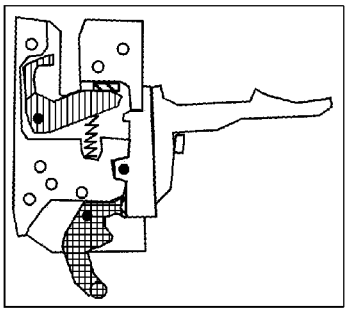
Figure 9A:
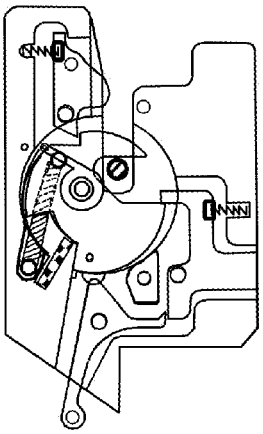
Figure 9D:
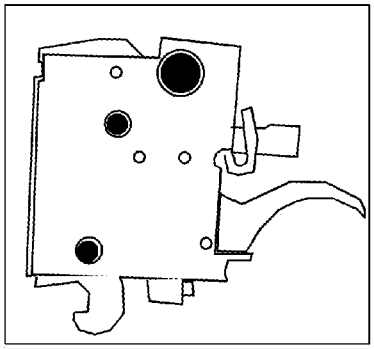

FIGS. 8 A through 8 D are example steps of the rotary cam release/trigger device as it operates to release a bow string.

FIGS. 9 A through 9 F and FIGS. 10 A through 10 F are parts and sketches of prior art devices.

DESCRIPTION OF THE DRAWINGS—REFERENCE NUMERALS

The following list refers to the drawings:

TABLE B

Reference numbers

| Ref # | Description |
|---|---|
| 30 | general rotary cam trigger with preferred dry fire/release device for a cross bow |
| 30A | alternative embodiment rotary cam trigger/release device for a cross bow |
| 31 | sketch of device with improved dry fire |
| 31A | sketch of alternative device with an original alternative dry fire |
| 32 | rotary cam trigger concept |
| 34++ | crossbow |
| 35 | sample rotary cam trigger/release with improved dry fire |
| 40 | trigger housing |
| 40A++ | side rails of the crossbow |
| 40B | mounting apertures (and alternatives apertures) housing 40 to rails 40A |
| 40C | arrow slot |
| 41 | spring pocket at sear pocket area |
| 41A | spring pocket at dry-fire pocket area |
| 41B | spring pocket safety hammer pocket area |
| 42 | rotary cam pivot pin |
| 43 | dry fire pivot pin |
| 44 | safety hammer pivot pin |
| 45 | sear pivot pin |
| 46 | cam pocket, cam spring pocket and shelf 46A |
| 46A | additional clearance at cam pocket for tension springs 92A/92B |
| 47 | dry fire pocket for improved dry fire location |
| 48 | safety hammer pocket |
| 49 | sear pocket |
| 49A | stop pocket |
| 50 | spring operated, pivotal Sear |
| 50A | aperture 50A for connecting (pin 50B and aperture 50A, etc.) sear 50 to linkage 85 |
| 50B | Pin for connecting sear 50 to linkage 85 and linkage 85 to trigger 86 |
| 51 | sear to cam finger (extension) |
| 52 | sear to safety hammer flat (on sear) |
| 52A | safety hammer to sear flat (on safety hammer) |
| 53 | sear to cam interference flat (angled approximately 7-10 degrees back angle or counter clockwise off 12 o'clock/ 0 degrees i.e. 350 to 353 cam to mate with sear) |
| 54 | sear pivot pin aperture |
| 55 | sear spring pocket |

TABLE B-continued

Reference numbers

| Ref # | Description |
|---|---|
| 60 | rotary cam - spring operated pivotal cam bowstring release latch mechanism |
| 61 | cam notch on alternative embodiment for engaging dry fire 80 above arrow slot |
| 62 | cam ball with spring detent for safety hammer interface |
| 63 | cam to sear interference flat (angled approximately 7-10 degrees back angle or counter clockwise off 12 o'clock/ 0 degrees i.e. 350 to 353 cam to mate with sear) |
| 64 | bow string slot and radius |
| 65 | cam pivot aperture |
| 67 | cam stop flat |
| 68 | spring retention posts |
| 69 | bowstring retaining claw(s) |
| 70 | safety hammer |
| 70A | trigger spring pocket |
| 71 | safety hammer thumb extension |
| 72 | safety hammer pivot pin aperture |
| 73 | cam ball lobe on safety hammer |
| 74 | sear stop extension leg |
| 80 | dry fire cam mechanism |
| 80A | lobe from arrow or bolt shaft |
| 80B | dry fire notch to interfere with cam pin 83 |
| 82 | pivot aperture |
| 83** | interference pin of rotary cam 60 with dry fire notch 80B |
| 84 | dry-fire spring pocket |
| 85++ | linkage - sear to trigger pull |
| 85A++ | means for connecting (pin and aperture, etc.) linkage 85 to sear 50 |
| 85B++ | means for connecting (pin and aperture, etc.) linkage 85 to trigger 86 |
| 86++ | trigger pull |
| 86A++ | means for connecting (pin and aperture, etc.) trigger pull 86 to linkage 85 |
| 88 | cross bow scope |
| 90 | bow string |
| 91 | compression spring - for sear, safety hammer and dry fire |
| 92A | heavy duty spring (preferred) - helical/extension/tension springs |
| 92B | torsion spring (alternative option) |
| 93 | cam stop cushion |
| 94 | arrow |
| 95 | release device in fully cocked and ready position with all stops in place |
| 96 | dry fire lobe (81) and arrow (94) are engaged and rotate the dry fire (80) about pivot (43) disengaging pin (83) |
| 97 | rotation of dry fire |
| 98 | insertion of arrow or bolt (loading) |
| 99 | safety hammer (70) rotated about pin (44) and disengaging leg (74) and sear flat (52) |
| 100 | rotation of safety hammer |
| 101 | trigger (86) and linkage (85) pulled to rotate sear (50) about pin (45) which disengage reference points (sear 53, cam 63) which releases cam (60) to rotate [from compression spring 92A] and thrust bowstring (90) against arrow (98) in slots (cam 64 and housing 40C). cam (60) stops when cam flat (67) engages cushion stop (93). |
| 102 | trigger motion compresses spring (91) |
| 103 | sear pivots |
| 104 | main trigger spring 92A contracts |
| 105 | rotary cam 60 rotates and aligns rotary cam bow string slot and radius 64 with arrow slot 40C of trigger housing 40 |
| 106 | bowstring 90 thrusts to release tension and engages arrow 94 |
| 107 | arrow 94 launches |
| 110 | prior art parts |
| 111 | prior art parts |
| 112 | prior art sketch |
| 113 | prior art parts |
| 114 | prior art parts |
| 115 | prior art parts |
| 116 | prior art patents |
| 117 | prior art patents |
| 118 | prior art patents |
| 119 | prior art patents |
| 120 | prior art patents |
| 121 | prior art patents |

DETAILED DESCRIPTION OF PREFERRED EMBODIMENT

The present development is a rotary cam release/trigger devices for a crossbow. Particularly the present disclosure is directed to a trigger mechanism having a cam operated release, an improved dry-fire prevention mechanism, and a convenient spring operated safety release. For archery equipment and, more particularly, a crossbow, the bowstring release assembly provides control and consistency in the release of a bowstring.

The advantages for the rotary cam release/trigger devices for a crossbow 30 are listed above in the introduction. Succinctly the benefits are that the device:

1 Fast release
2 Full safety (dry fire & safety hammer)
3 Easy location for spring operated safety release by the user's hand or fingers
4 Smooth bowstring to arrow path (no interference)
5 Fewer parts compared to traditional release/triggers
6 May be interchanged with existing trigger/release mechanisms in crossbow units.
7 OEM and replacement sales The preferred embodiment is a rotary cam release/trigger devices for a crossbow comprised of a spring operated pivotal cam string release mechanism for releasably holding a bowstring in a drawn position, the cam release latch is pivotable about a pivot point and has associated therewith a first sear surface; a pivotal rocker latch member having a second sear surface which engages the cam pivot mechanism; the pivotal sear which has an extended arm that engages a safety hammer release; a spring operated safety hammer release; an improved dry-fire prevention pivot mechanism that engages an arrow when loaded to launch; a linkage to a trigger pull; the trigger pull; and an encasement that essentially contains all the components and provides the structure to maintain the pivots and the structural continuity to the release device for mounting the release to the crossbow between the side rails and wherein the release device provides a safe and reliable trigger mechanism which enhances accurate shooting with the crossbow.

There is shown in FIGS. 1-10 a complete description and operative embodiment of the rotary cam release/trigger devices for a crossbow. In the drawings and illustrations, one notes well that the FIGS. 1-10 demonstrate the general configuration and use of this product. The various example uses are in the operation and use section, below.

The accompanying drawings, which are incorporated in and constitute a part of this specification, illustrate an embodiment of the rotary cam release/trigger devices for a crossbow 30 that is preferred. The drawings together with the summary description given above and a detailed description given below serve to explain the principles of the rotary cam release/trigger devices 30 for a crossbow 34. It is understood, however, that the trigger device 30 is not limited to only the precise arrangements and instrumentalities shown. Other examples of trigger/release devices 30 and uses are still understood by one skilled in the art of crossbows and bowstring release mechanisms to be within the scope and spirit shown here.

Figures 1, 1A, 1B, 1C, 1D:
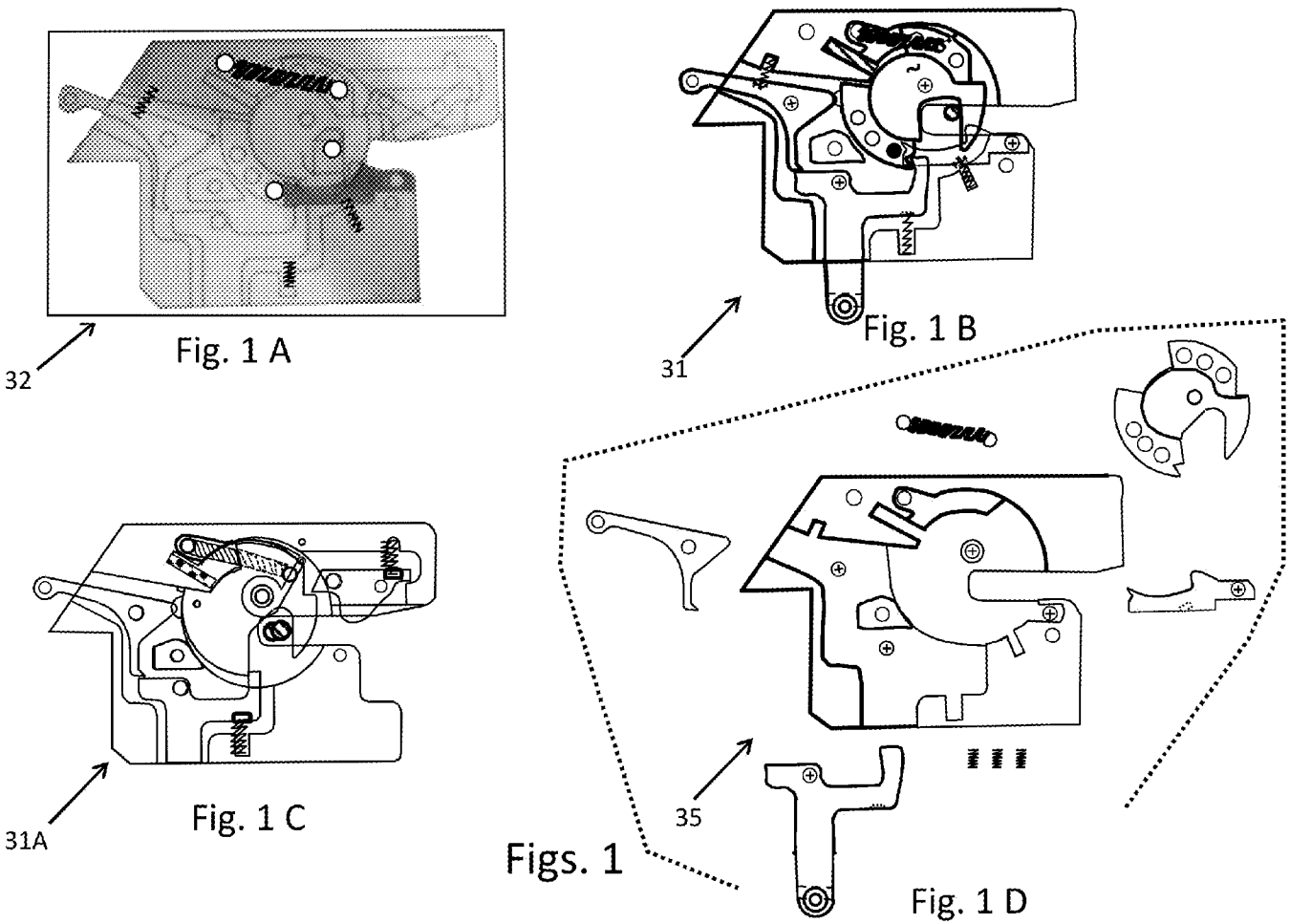

FIGS. 1 A through 1 D are sketches of the general rotary cam release/trigger device 30 for a cross Bow 34. FIG. 1 A shows a sketch of the rotary cam trigger concept 32. FIG. 1 B shows a sketch of device 31 with the preferred tension spring 92A. FIG. 1 C shows the alternative embodiment 31A. FIG. 1 D shows a sample rotary cam trigger/release 35.

FIGS. 2 A and 2 B are sketches of the preferred and alternative rotary cam release/trigger devices with components and features noted. FIG. 2 A is the preferred embodiment. Components are showed in more detail in FIG. 3, below. As a general introduction: Firstly shown is the main trigger housing 40. Secondly is the sear 50. Thirdly is the rotary cam 60. Fourthly, is a spring operated safety hammer 70. Fifthly is the dry fire cam 80. More component details are in FIG. 3.

FIG. 2 B is a sketch of an alternative embodiment of a rotary cam release/trigger device 30A with most of the components and features noted. Firstly shown is the main trigger housing 40 with the spring pocket 41 for holding the compression spring 91 at the sear, the spring pocket 41A for holding the compression spring 91 at the dry fire cam, the rotary cam pivot pin 42, the dry-fire pivot pin 43, and the safety hammer pivot pin 44. Other recesses and pockets are the arrow slot 40C, the cam pocket 46, the dry-fire pocket or recess 47, the safety hammer recessed area 48, the sear pocket 49, and the stop pocket 49A for holding the stop cushion 93 (pocket and stop not shown in all the views). Secondly is the sear 50 with its pin aperture 54, the sear to cam finger or extension 51, the sear and safety hammer flat configuration or plateau 52, 52A, the spring pocket 55, and the cam interference point 53 [essentially angled about 7-10 degrees minus or from perpendicular to mate with the cam]. Thirdly is the rotary cam 60 with the cam notch 61 for the dry-fire cam 80, the cam/ball detent 62 for holding and then releasing the trigger lobe 73, the cam to sear interference point 63 [essentially angled opposite to the sear point 53—about 7 degrees plus or past perpendicular, the bowstring slot and radius 64, the cam pivot pin aperture 65, the spring apertures 66 (not shown in this view), the cam stop flat 67 (not shown in this view), the alternative cam torsion spring 92B and retention posts 68 (posts not shown in this view but shown elsewhere), and the bowstring retaining claw 69. Fourthly, is the safety hammer 70 with the pivot pin aperture 72, the thumb extension 71, the cam ball lobe 73 (for interference with ball detent 62), and the sear stop extension leg 74 that mates with the sear flat 52. Fifthly is the dry fire cam 80 with the pin aperture 82, the lobe 80A for the arrow shaft 94, the spring pocket 84, the second compression spring 91, and the interference point 83 for securing the cam 60. Sixthly are the linkage 85 and trigger pull 86 pivotally linked to each other at one end of the linkage 85 and the linkage 85 pivotally linked to the sear 50 at the end of the linkage opposite to the pull 86. Seventhly and finally, the side rail 40B (not shown here) mounting apertures 40C and the bowstring 90 are demonstrated.

Figure 3:
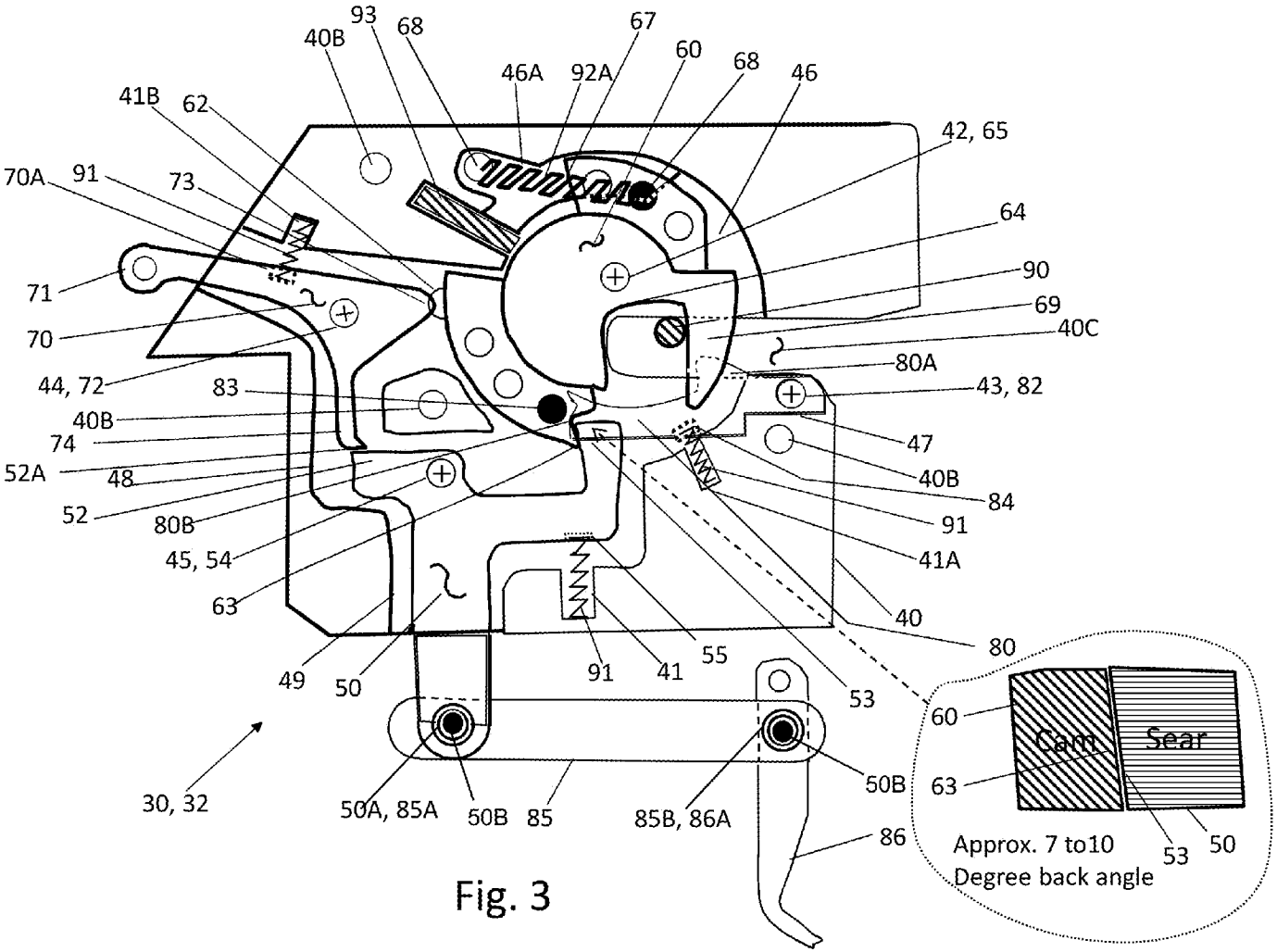
FIG. 3 is a sketch of a rotary cam release/trigger device with components and features shown from generally a top view.

FIG. 3 is a sketch of a preferred embodiment of a rotary cam release/trigger device with components and features shown from generally a top view. Firstly shown is the main trigger housing 40 with the spring pocket 41 for holding the compression spring 91 at the sear, the spring pocket 41A for holding the compression spring 91 at the dry fire cam, spring pocket 41B for holding the compression spring 91 at the safety hammer, the dry fire cam the rotary cam pivot pin 42, the dry-fire pivot pin 43, the safety hammer pivot pin 44 and the sear pivot pin 45. Other recesses and pockets are the arrow slot 40C, the cam pocket 46, a relief 46A for the heavy tension spring 92A, the dry-fire pocket or recess 47, the safety hammer recessed area 48, the sear pocket 49, and the stop pocket 49A for holding the stop cushion 93, the mounting apertures 40B and the spring pin 68 for mounting the cam release spring 68. Secondly is the sear 50. This shows the its pin aperture 54, the sear to cam finger or extension 51, the sear and safety hammer flat configuration or plateau 52, the spring pocket 55, and the cam interference point 53 [essentially angled about 7 to 10 degrees back angle minus or Counter Clockwise from perpendicular to mate with the cam flat 63]. Thirdly is the rotary cam 60 with the cam pin 83 for holding the dry-fire cam 80 at detent 80B, the cam/ball detent 62 for holding and then releasing the trigger lobe 73, the cam to sear interference point 63 [essentially angled opposite to the sear point 53—about 7 to 10 degrees plus or past perpendicular, the bowstring slot and radius 64, the cam pivot pin aperture 65, the spring pin 68, the cam stop flat 67, the preferred spring 92A on the retention posts 68 at each end (note that one is in an aperture of the housing 40 and the other in an aperture of the cam 60—not shown in this view but shown elsewhere), and the bowstring retaining claw 69. Fourthly, is a spring operated safety hammer 70 with the pivot pin aperture 72, the thumb extension 71, the cam ball lobe 73 (for interference with ball detent 62), the sear stop extension leg 74 that mates with the sear at flat 52A, and the spring pocket 70A for another spring 91. Fifthly is the dry fire cam 80 with the pin aperture 82, the lobe 80A for the arrow shaft 94, the spring pocket 84, the second compression spring 91, and the interference point 80B for engaging the stop pin 83 on the cam 60. Sixthly are the linkage 85 and trigger pull 86 pivotally linked to each other at one end of the linkage 85 and the linkage 85 pivotally linked to the sear 50 at the end of the linkage opposite to the pull 86. One notes the linkage 85 is connected by a means 85A to the sear 50 and to the trigger pull 86 by a connecting means 85B, 86A. Seventhly and finally, the side rail 40B (not shown here) mounting apertures 40C and the bowstring 90 are demonstrated.

Figure 4:
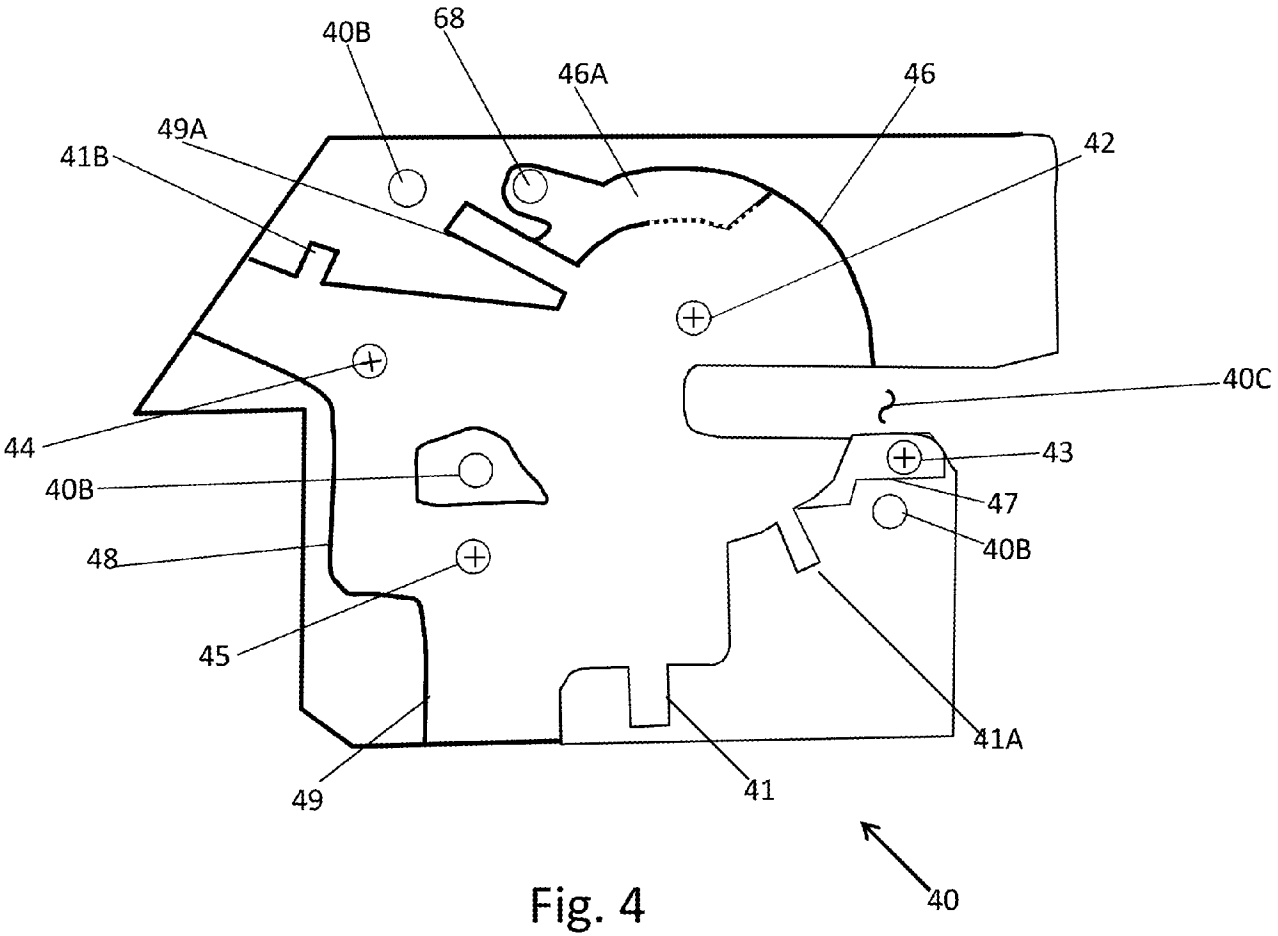
FIG. 4 is a sketches of a trigger encasement of a rotary cam release/trigger devices with the components and features shown from generally a top view.

FIG. 4 is a sketch of a trigger encasement 40 of a rotary cam release/trigger device with the components and features shown from generally a top view. Here shown is the main trigger housing 40 with the spring pocket 41 for holding the compression spring 91 at the sear, the spring pocket 41A for holding the compression spring 91 at the dry fire cam, spring pocket 41B for holding the compression spring 91 at the safety hammer, the dry fire cam the rotary cam pivot pin 42, the dry-fire pivot pin 43, the safety hammer pivot pin 44 and the sear pivot pin 45. Other recesses and pockets are the arrow slot 40C, the cam pocket 46, a relief 46A for the heavy tension spring 92A, the dry-fire pocket or recess 47, the safety hammer recessed area 48, the sear pocket 49, and the stop pocket 49A for holding the stop cushion 93, the mounting apertures 40B and the spring pin 68 for mounting the cam release spring 68.

Figure 5:
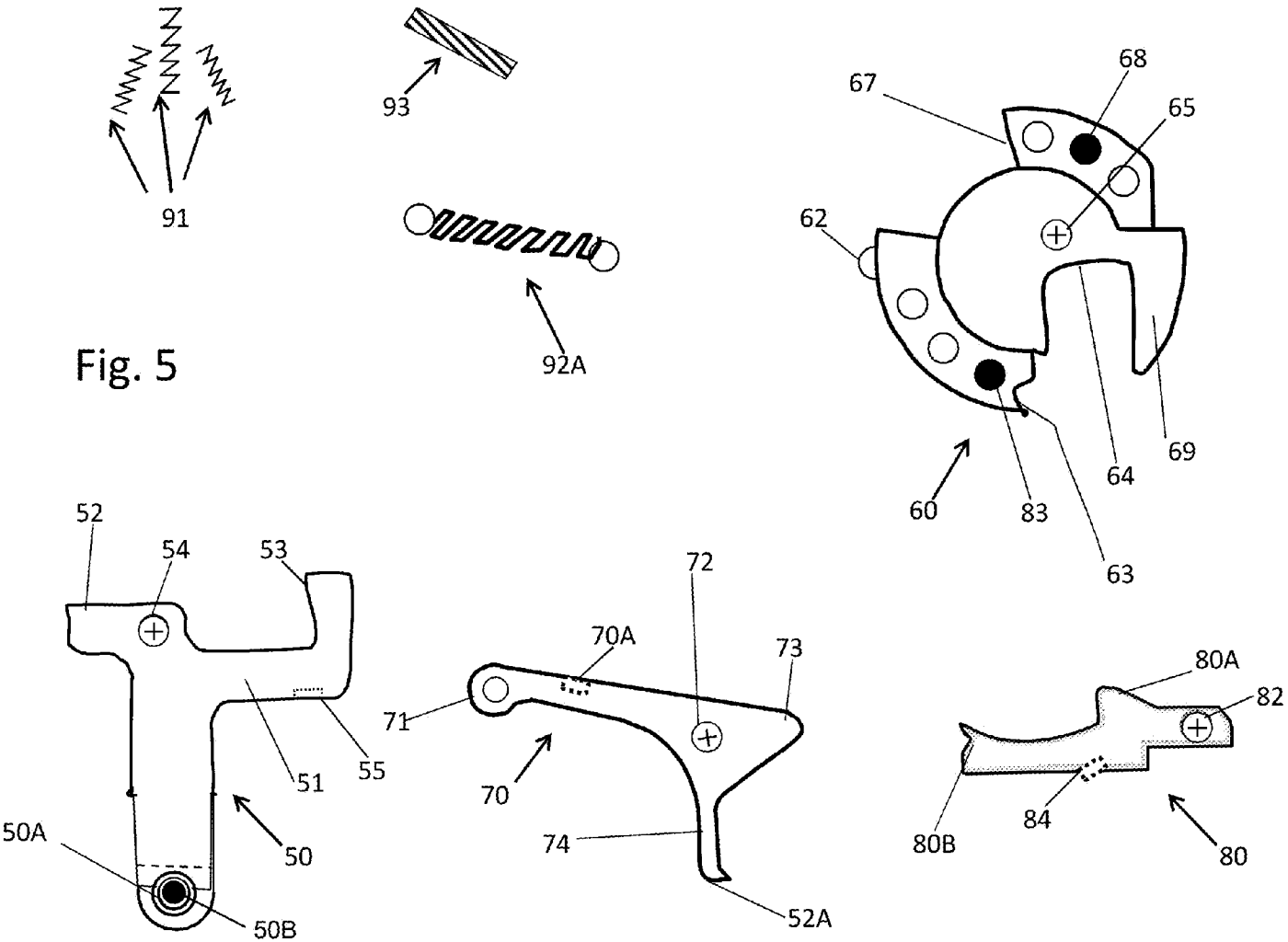
FIG. 5 are sketches of the device components and feature shown from generally a top view.

FIG. 5 are sketches of the device components and feature shown from generally a top view. Included is the sear 50. This shows the its pin aperture 54, the sear to cam finger or extension 51, the sear and safety hammer flat configuration or plateau 52, the spring pocket 55, and the cam interference point 53 [essentially angled about 7 degrees minus or from perpendicular to mate with the cam]. Next is the rotary cam 60 with the cam pin 83 for holding the dry-fire cam 80 at detent 80B, the cam/ball detent 62 for holding and then releasing the trigger lobe 73, the cam to sear interference point 63 [essentially angled opposite to the sear point 53—about 7 degrees plus or past perpendicular, the bowstring slot and radius 64, the cam pivot pin aperture 65, the spring pin 68, the cam stop flat 67, the preferred spring 92A on the retention posts 68 at each end (note that one is in an aperture of the housing 40 and the other in an aperture of the cam 60) (not shown in this view but shown elsewhere), and the bowstring retaining claw 69. Further shown is the spring operated safety hammer 70 with the pivot pin aperture 72, the thumb extension 71, the cam ball lobe 73 (for interference with ball detent 62), the sear stop extension leg 74 that mates with the sear flat 52, and the spring pocket 70A for another spring 91. In addition is the dry fire cam 80 with the pin aperture 82, the lobe 80A for the arrow shaft 94, the spring pocket 84, the second compression spring 91, and the interference point 80B for engaging the stop pin 83 on the cam 60. Finally is the cam bump pad 93. Not shown are the linkage 85 and trigger pull 86 shown above in FIG. 3 or the side rail 40B shown below in FIG. 7.

FIGS. 6 A and 6 B are prototype parts of the rotary cam release/trigger device 30. FIG. 6 A shows the rotary cam 60 with the cam pin location for pin 83 for the dry-fire cam 80, the cam/ball detent 62 for holding and then releasing the trigger lobe 73, the cam to sear interference point 63 [angled opposite to the sear point 53—about 7 degrees plus or past perpendicular, the bowstring slot and radius 64, the cam pivot pin aperture 65, the spring posts to hold the spring pins 68, and the cam stop flat 67. FIG. 6 B shows the sear 50, the safety hammer 70, the dry fire cam 80, the cam stop cushion 93, and the spring 91. The other features were described in Paragraph 2, above.

FIGS. 7 A and 7 D are views of the rotary cam release/trigger device 30 mounted onto a crossbow 34. FIG. 7 A shows the trigger 86 and the scope 88. FIG. 7 B and FIG. 7 C show the scope 88, the trigger housing 40, and the crossbow side rails 40A, between which the housing 40 is mounted with the apertures 40C and fasteners. FIG. 7 D shows the crossbow 34, trigger 86, the housing location 40 and the scope 88.

FIGS. 8 A through 8 D are example steps of the rotary cam release/trigger device 30 as it operates to release a bow string 90 of the crossbow. These operational steps are described below in the operations section.

FIGS. 9 A through 9 F and FIGS. 10 A through 10 F are parts and sketches of prior art devices. Here in the FIG. 9 are shown: prior art parts 110, prior art parts 111, prior art parts 112, prior art parts 113, prior art parts 114, prior art parts 115, prior art parts 116, prior art parts 117, prior art parts 118, prior art parts 119, prior art parts 120, and prior art parts 121. One skilled in the art of trigger devices can readily see the improvements and fewer parts with the Kennedy rotary cam release/trigger devices for a crossbow.

Various materials may be utilized in the manufacturing of the rotary cam release/trigger device 30 for a crossbow 34. As an example and not as a limitation, the components may be of various machined or cast metals including steel, steel alloys, stainless steel, composite materials including various plastics, both reinforced and virgin resins. The plethora of various materials are anticipated fully in the spirit and scope of the invention presented here. Also, the rotary cam actuation springs 92A, 92B may be a variety of compression or torsion springs as desired for the speed and smoothness of the cam action.

The details mentioned here are exemplary and not limiting. Other specific components and manners specific to describing a rotary cam release/trigger device 30 for a crossbow 34 may be added as a person having ordinary skill in the field of crossbows and bowstring release mechanisms and their uses well appreciates.

Operation of the Preferred Embodiment

The rotary cam release/trigger device 30 for a crossbow has been described in the above embodiment. The manner of how the device operates is described below. One notes well that the description above and the operation described here must be taken together to fully illustrate the concept of the rotary cam release/trigger device 30 for a crossbow. The preferred embodiment of the rotary cam release/trigger device 30 for a crossbow is comprised of a spring operated pivotal cam string release mechanism for releasably holding a bowstring in a drawn position, the cam release latch is pivotable about a pivot point and has associated therewith a first sear surface; a pivotal rocker latch member having a second sear surface which engages the cam pivot mechanism; the pivotal sear which has an extended arm that engages a safety hammer release; a spring operated safety hammer release; a dry-fire prevention pivot mechanism that engages an arrow when loaded to launch; a linkage to a trigger pull; the trigger pull; and an encasement that essentially contains all the components and provides the structure to maintain the pivots and the structural continuity to the release device for mounting the release to the crossbow between the side rails and wherein the release device provides a safe and reliable trigger mechanism which enhances accurate shooting with the crossbow.

The rotary cam release/trigger device 30 for a crossbow 34 is placed into a crossbow 34 somewhat similar to a conventional trigger/release mechanisms. The device 30 is contained within the housing 40. That housing and all the contents secured within is placed between the side rails 40A of the crossbow 34. The mounting apertures 40B of the housing 40 are aligned with the apertures in the side rails 40A. Then the fasteners releasably yet rigidly secure the housing 40 between the side rails 40A.

The operation of device 30 is significantly different. The rotary cam release/trigger device 30 for a crossbow 34 functions as shown in FIGS. 8 A through 8 D. These figures are example steps of the rotary cam release/trigger device 30 as it operates to release a bow string 90. FIG. 8 A shows the release device 30 in fully cocked and ready position with all stops in place—Action/start position 95. FIG. 8 B shows dry fire lobe 81 and arrow 94 engaged and the cam lobe 80A urges and rotates dry fire 80 about pivot 43 disengaging cam pin 83—Action 96. Shown here is the rotation of dry fire—Action 97 due to the movement and insertion of arrow 94 (loading) against the lobe 80A—Action 98. FIG. 8 C shows the safety hammer 70 rotated about pin 44 and disengaging leg 74 and the sear flat 52—Action/position 99. Here is shown the rotation of safety hammer—Action 100. Finally, FIG. 8 D shows trigger 86 and linkage 85 pulled to rotate sear 50 about pin 45 which disengages sear 50 and cam 60 at shown reference points (sear 53, cam 63). This then releases cam 60 to rotate [from torsion spring 92A] and thrust the bowstring 90 against the arrow 94 in slots (cam 64 and housing 40C). Again, please note the relationship of the bowstring 90 and the retention claw 69. Cam 60 stops when cam flat 67 engages cushion 93—Action 101. As all this occurs, the trigger motion compresses sear spring 91—Action 102; the sear pivots—Action 103; main trigger spring 92A contracts—Action 104; rotary cam 60 rotates and aligns rotary cam bow string slot and radius 64 with arrow slot 40C of trigger housing 40—Action 105; Bowstring 90 thrusts to release tension of string and engages arrow 94—Action 106; and arrow 94 launches—Action 107

With this description it is to be understood that the rotary cam release/trigger device for a crossbow 30 is not to be limited to only the disclosed embodiment of product. The features of the rotary cam release/trigger device 30 for a crossbow are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless they are defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other of the embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless they are otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. A rotary cam release device (30) for a crossbow (34) comprised of:

a. a spring operated safety hammer (70) with a cam ball lobe (73) for engaging a rotary cam (60), a sear stop extension leg (74) with a safety hammer to sear flat (52A) for engaging a spring operated, pivotal sear (50), and a pivot aperture (72) for a pivot pin (44);

b. the spring operated, pivotal sear (50) with a sear to safety hammer flat (52) for engaging the spring operated safety hammer (70), a sear to cam interference flat (53) for engaging the rotary cam (60), and an aperture 50A means for engaging a linkage (85);

c. a contiguous flat (53) between the safety hammer to sear flat (52A) of the sear and the sear to safety hammer flat (52);

d. the rotary cam (60) further comprised of

[1] a bowstring claw (69), for releasably holding a bowstring (90) in a drawn position,

[2] an interface flat (63) to engage the spring operated, pivotal sear (50),

[3] a pin (68) to engage a rotation means (92A, 92B);

[4] a pin (83) to engage a dry fire cam (80), and

[5] a spring detent ball (62) to engage the means of engagement with the safety hammer (70);

e. a contiguous interface flat whereby the interface flat (53) of the spring operated, rotary cam (60) engages the interface flat (63) of the rotary cam (60) whereby the each of the flats (53, 63) is further configured as a back angle approximately 7-10 degrees and counter clockwise off 12 o'clock or approximately angled 350 to 353 degrees with continuous interface;

f. a spring operated, pivotal dry fire cam (80) with a means (83) for engaging the rotary cam (60);

g. a rotation means (92A) between an encasement housing (40) and rotary cam (60);

h. the encasement housing (40) that is essentially configured to contain a set of components which includes the spring operated, pivotal sear (50), the safety hammer (70), the dry fire cam (80), the rotary cam (60), the spring (92A), and that provides an arrow notch (40C) and a structure to maintain pivotal-able and structural continuity to the release device (30);

i. a plurality of springs (91) interposed between an encasement housing (40) and the sear (50), the safety hammer (70), and the dry fire cam (80);

j. a plurality of pins (42, 43, 44, and 45) interposed between the encasement housing (40) and the spring operated, pivotal sear rocker latch member (50), the safety hammer (70), the dry fire cam (80), and the rotary cam (60);

k. the linkage (85) with a apertures (85A, 86A) for connecting to the sear (50) and to a trigger pull (86);

l. the trigger pull (86); and m. a pair of pins (50B) for connecting the linkage (85) to the sear (50) and the linkage (85) to the trigger (86), respectively;

wherein the release device (30) is mountable to the crossbow (34) on a set of slide rails (40A) and wherein the release device (30) provides a safe and reliable trigger mechanism which enhances accurate shooting with the crossbow (34).

2. The rotary cam release device (30) as in claim 1, wherein the sear rocker latch member (50), the safety hammer (70), the dry fire cam (80), the rotary cam (60) and the encasement housing (40) are comprised of materials from a group selected from the group consisting of various machined and cast metals including steel, steel alloys, stainless steel, composite materials, virgin plastics resins, reground plastic resins and reinforced plastic resins.

3. The rotary cam release device (30) as in claim 1 wherein the device (30) is further comprised of a cam stop (93) inserted in a cam pocket in the encasement housing (40).

4. The rotary cam release device (30) as in claim 1 wherein the safety hammer (70) is further comprised of a pivot aperture (72) for the pivot pin (44) and spring pocket (70A) for a spring (91).

5. The rotary cam release device (30) as in claim 1 wherein the spring operated, pivotal sear rocker latch member (50) is further comprised of a pivot aperture (54) for the pivot pin (45) and a spring pocket (55) for a spring (91).

6. The rotary cam release device (30) as in claim 1 wherein the spring operated, rotary cam (60) is further comprised of a pivot aperture (65) for the pivot pin (42), an aperture for spring pin (68), and an aperture for dry fire pin (83).

7. The rotary cam release device (30) as in claim 6 wherein the spring operated, rotary cam (60) is further comprised of a stop flat (67) for the cushion (93).

8. The rotary cam release device (30) as in claim 1 wherein the interface flat (63) of the spring operated, rotary cam (60) is further configured as a flat angled approximately 7-10 degrees as a back angle and counter clockwise off 12 o'clock or approximately angled 350 to 353 degrees interface with the flat (53) of the spring operated, pivotal sear rocker latch member (50).

9. The rotary cam release device (30) as in claim 1 wherein the spring operated, pivotal dry fire cam (80) is further comprised of an arrow lobe means (80 A), a pivot aperture (83) to engage with pivot pin (43), and a dry fire notch (80B) to interfere with cam pin (83).

10. A rotary cam release device (30) for a crossbow (34) comprised of:

a. a spring operated safety hammer (70) with a cam ball lobe (73) for engaging a rotary cam (60), a sear stop extension leg (74) with a safety hammer to sear flat (52A) for engaging a spring operated, pivotal sear (50), a pivot aperture (72) for a pivot pin (44), a spring pocket (70A), a safety hammer pivot pin aperture (72), and a safety hammer thumb extension (71);

b. the spring operated, pivotal sear (50) with a sear to safety hammer flat (52) for engaging the spring operated safety hammer (70), a sear to cam interference flat (53) for engaging the rotary cam (60), an aperture 50A means for engaging a linkage (85); a spring pocket (55E), and a pivotal sear pivot pin aperture (54);

c. a contiguous flat (53) between the safety hammer to sear flat (52A) of the sear and the sear to safety hammer flat (52);

d. the rotary cam (60) further comprised of

[1] a bowstring claw (69), for releasably holding a bowstring (90) in a drawn position,

[2] an interface flat (63) to engage the spring operated, pivotal sear (50),

[3] a pin (68) to engage a rotation means (92A, 92B);

[4] a pin (83) to engage a dry fire cam (80),

[5] a spring detent ball (62) to engage the means of engagement with the safety hammer (70),

[6] a pivot aperture (65) for the pivot pin (42), an aperture for spring pin (68) and an aperture for dry fire pin (83),

[7] a stop flat (67) for cushion (93), and;

[8] a bow string slot and radius (64);

e. a contiguous interface flat whereby the interface flat (53) of the spring operated, rotary cam (60) engages the interface flat (63) of the rotary cam (60);

f. a spring operated, pivotal dry fire cam (80) with a means (83) for engaging the rotary cam (60);

g. a rotation means (92A) between an encasement housing (40) and rotary cam (60);

h. the encasement housing (40) that is essentially configured to contain a set of components which includes the spring operated, pivotal sear (50), the safety hammer (70), the dry fire cam (80), the rotary cam (60), the spring (92A), and that provides an arrow notch (40C) and a structure to maintain pivotal-able and structural continuity to the release device (30);

i. a plurality of springs (91) interposed between an encasement housing (40) and the sear (50), the safety hammer (70), and the dry fire cam (80);

j. a plurality of pins (42, 43, 44, and 45) interposed between the encasement housing (40) and the spring operated, pivotal sear rocker latch member (50), the safety hammer (70), the dry fire cam (80), and the rotary cam (60);

k. the linkage (85) with a apertures (85A, 86A) for connecting to the sear (50) and to a trigger pull (86);

l. the trigger pull (86);

m. a pair of pins (50B) for connecting the linkage (85) to the sear (50) and the linkage (85) to the trigger (86), respectively; and n. a cam stop (93) inserted in a cam pocket in the encasement housing (40)

wherein the release device (30) is mountable to the crossbow (34) on a set of slide rails (40A) and wherein the release device (30) provides a safe and reliable trigger mechanism which enhances accurate shooting with the crossbow (34).

* * * * *